US008726946B2

(12) United States Patent
Clüsserath et al.

(10) Patent No.: US 8,726,946 B2
(45) Date of Patent: May 20, 2014

(54) METHOD FOR FILLING BOTTLES OR SIMILAR CONTAINERS WITH AN OXYGEN SENSITIVE EFFERVESCENT LIQUID BEVERAGE FILLING MATERIAL UNDER COUNTERPRESSURE AND FILLING MACHINE FOR THE PERFORMANCE OF THIS METHOD

(71) Applicants: Ludwig Clüsserath, Bad Kreuznach (DE); Dieter-Rudolf Krulitsch, Bad Kreuznach (DE); Manfred Härtel, Bretzenheim (DE)

(72) Inventors: Ludwig Clüsserath, Bad Kreuznach (DE); Dieter-Rudolf Krulitsch, Bad Kreuznach (DE); Manfred Härtel, Bretzenheim (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/781,317

(22) Filed: Feb. 28, 2013

(65) Prior Publication Data

US 2013/0180619 A1 Jul. 18, 2013

Related U.S. Application Data

(63) Continuation of application No. 12/545,339, filed on Aug. 21, 2009, now abandoned.

(51) Int. Cl.
*B65B 31/00* (2006.01)
*B67C 3/00* (2006.01)

(52) U.S. Cl.
USPC ..... 141/6; 141/39; 141/52; 141/59

(58) Field of Classification Search
USPC ..... 141/197, 4–8, 37–64, 144–147, 290; 53/432
See application file for complete search history.

(56) References Cited

U.S. PATENT DOCUMENTS

| | | | | |
|---|---|---|---|---|
| 4,976,295 | A | 12/1990 | Clüsserath | |
| 6,192,946 | B1 * | 2/2001 | Clusserath | 141/40 |
| 6,463,964 | B2 * | 10/2002 | Clusserath | 141/40 |
| 6,470,922 | B2 * | 10/2002 | Sindermann | 141/37 |
| 6,474,368 | B2 * | 11/2002 | Clusserath et al. | 141/6 |
| 7,469,726 | B2 * | 12/2008 | Clusserath et al. | 141/57 |
| 2002/0014276 | A1 * | 2/2002 | Clusserath | 141/40 |
| 2005/0241726 | A1 * | 11/2005 | Clusserath et al. | 141/144 |
| 2010/0071802 | A1 * | 3/2010 | Clusserath et al. | 141/44 |

FOREIGN PATENT DOCUMENTS

| | | |
|---|---|---|
| CN | 1680185 | 10/2005 |
| DE | 42 01 698 | 7/1993 |
| EP | 1 162 167 | 12/2001 |
| EP | 1 216 952 | 6/2002 |
| EP | 1 584 601 | 10/2005 |
| JP | 1037397 | 2/1989 |

* cited by examiner

*Primary Examiner* — Timothy L Maust
*Assistant Examiner* — Brandon J Warner
(74) *Attorney, Agent, or Firm* — Nils H. Ljungman & Associates

(57) ABSTRACT

A method for filling bottles or similar containers with an oxygen sensitive effervescent liquid beverage filling material under counterpressure and a filling machine for the performance of this method are disclosed.

20 Claims, 6 Drawing Sheets

| Step | Valve 22 | Valve 23 | Valve 24 | Valve 18 | Flow |
|---|---|---|---|---|---|
| 1st evacuation | closed | open | closed | closed | O2 from bottle 2 to vacuum duct 30 |
| 1st CO2 fill | open | closed | closed | closed | gas from return duct 29 to bottle 2 |
| 2nd evacuation | closed | open | closed | closed | gas from bottle 2 to vacuum duct 30 |
| 2nd CO2 fill | open | closed | closed | closed | gas from return duct 29 to bottle 2 |
| Final evacuation | closed | open | closed | closed | gas from bottle 2 to vacuum duct 30 |
| Partial Pressurization | open | closed | closed | closed | gas from return duct 29 to bottle 2 |
| Final pressurization | closed | closed | open | closed | gas from gas sink 31 to bottle 2 |
| Liquid filling | closed | closed | open | open | liquid from 14 to bottle 2<br>gas from bottle 2 to return duct 29 and gas sink 31 |
| Corrective filling | closed | closed | closed | open | gas from bottle 2 to return duct 29 |

FIG. 3

METHOD FOR FILLING BOTTLES OR SIMILAR CONTAINERS WITH AN OXYGEN SENSITIVE EFFERVESCENT LIQUID BEVERAGE FILLING MATERIAL UNDER COUNTERPRESSURE AND FILLING MACHINE FOR THE PERFORMANCE OF THIS METHOD

CONTINUING APPLICATION DATA

This application is a continuation of copending U.S. patent application Ser. No. 12/545,339, which is a Continuation-In-Part application of International Patent Application No. PCT/EP2008/000316, filed on Jan. 17, 2008, which claims priority from Federal Republic of Germany Patent Application No. 10 2007 009 435.5, filed on Feb. 23, 2007. International Patent Application No. PCT/EP2008/000316 was pending as of the filing date of this application. The United States was an elected state in International Patent Application No. PCT/EP2008/000316.

BACKGROUND

1. Technical Field

The present application relates to a method for filling bottles or similar containers with an oxygen sensitive effervescent liquid beverage filling material under counterpressure and filling machine for the performance of this method.

2. Background Information

Background information is for informational purposes only and does not necessarily admit that subsequently mentioned information and publications are prior art.

The present application relates to a method for filling bottles or similar containers with a liquid under counterpressure, using a filling machine which has, on a rotor, a plurality of filling elements, a bowl that is common to the filling elements, whereby the interior of the bowl forms a liquid space which is occupied by the liquid being bottled and a headspace above the liquid for an inert gas under pressure (filling pressure), and at least one return gas duct which is common to the filling elements or to each of a group of filling elements, whereby before the filling, the interior of the container is pressurized by means of a controlled gas path of each filling element with inert gas originating from the headspace of the bowl and at the filling pressure, and during the filling at least some of the inert gas is displaced from the containers by the incoming liquid into the at least one return gas duct. The present application also relates to a filling machine with a rotary construction for the filling of bottles or similar containers with a liquid under counterpressure, with a bowl which is provided on a rotor that can be driven in rotation around a vertical machine axis, whereby the interior of the bowl forms a liquid space which is occupied by the liquid being bottled and a headspace above the surface of the liquid being bottled for an inert gas under pressure (filling pressure), with a plurality of filling elements located on the periphery of the rotor, each of which has a fluid duct which is in communication with the liquid space of the bowl and a discharge opening with a controlled liquid valve, with at least one common return gas duct on the rotor which is common to the filling elements or a group of filling elements, and with controlled gas paths realized in the filling elements, by means of which gas paths the individual container to be filled and located in sealed contact with a filling element can be pressurized with an inert gas at the filling pressure from the headspace of the bowl, and which makes possible a removal of the inert gas displaced from the containers during the filling at least partly to the return gas duct.

The filling of bottles or similar containers may include filling with a liquid, in one possible embodiment with a carbonated liquid such as beer, for example, with the use of counterpressure with a single-chamber filling system. In such processes, the liquid being bottled is prepared in a bowl which is common to a plurality of filling elements of a filling machine that employs a rotary construction, whereby the interior of the bowl is divided into a liquid chamber which is occupied by the liquid being bottled and a headspace which is located above it and is filled with an inert gas. The inert gas is thereby generally carbon dioxide or carbon dioxide gas. The entire bowl and its contents are thereby under bottling pressure.

Before the actual filling, each container located in sealed contact with the filling element is pressurized to the filling pressure with inert gas. The pressurization gas used for this purpose is at least partly the inert gas that is housed in the bowl and is extracted from the bowl for the purpose. During the filling, some of the pressurization or inert gas which is displaced from the respective container by the incoming liquid is returned into a rotor-side return gas duct which is common to the filling elements of the filling machine, but some of the gas is also returned to the headspace of the bowl, for economic reasons among other things, i.e. to reduce the consumption of inert gas.

To increase the shelf life and quality of the liquid being bottled, the interior of the containers that are in sealed contact with the filling elements can be flushed with inert gas one or more times before the pressurization, whereby the container is evacuated before and/or after each purging, and in one possible embodiment by a controlled connection of the interior of the individual bottle with a rotor-side vacuum duct which is common to the filling elements.

In spite of the evacuation and purging, however, a small amount of air or oxygen remains in the pressurized containers, so that during the filling not only is inert gas or carbon dioxide gas returned into the headspace of the bowl, but a certain amount of air and/or oxygen is returned along with it. As a result, the liquid being bottled begins to absorb oxygen while it is still in the bowl, and in one possible embodiment at the boundary surface between the liquid being bottled and the inert gas/oxygen mixture above it, which has an adverse effect on the shelf life and quality of the liquid being bottled.

OBJECT OR OBJECTS

An object of the present application is a method and a filling machine which achieves a low consumption of inert gas. In one possible embodiment the inert gas is carbon dioxide gas. The method may provide an economical operation and may avoid, restrict, and/or minimize the absorption of oxygen by the liquid in the bowl with its related disadvantages.

SUMMARY

The present application teaches that this object can be accomplished with a method for filling bottles or similar containers with a liquid under counterpressure, using a filling machine which has, on a rotor a plurality of filling elements, a bowl that is common to the filling elements. The interior of the bowl forms a liquid space which is occupied by the liquid being bottled and a headspace above the liquid for an inert gas under pressure. The filling machine comprises at least one return gas duct which is common to the filling elements or to each of a group of filling elements. Before the filling, the interior of the container is pressurized by means of a controlled gas path of each filling element with inert gas originating from the headspace of the bowl and at the filling pressure. During the filling at least some of the inert gas is displaced from the containers by the incoming liquid into the at least one return gas duct. The individual container is pressurized from at least one additional gas duct that functions as a gas sink and is common to the filling element or a group of filling elements. The additional gas duct is connected by means of at least one gas connection to the headspace of the bowl. This object may also be accomplished with a filling machine with a rotary construction for the filling of bottles or similar containers with a liquid under counterpressure. The filling machine comprises a bowl which is provided on a rotor that can be driven in rotation around a vertical machine axis. The interior of the bowl forms a liquid space which is occupied by the liquid being bottled and a headspace above the surface of the liquid being bottled for an inert gas under pressure (filling pressure). A plurality of filling elements are located on the periphery of the rotor, each of which has a fluid duct which is in communication with the liquid space of the bowl. The filling machine also comprises a discharge opening with a controlled liquid valve, with at least one common return gas duct on the rotor which is common to the filling elements or a group of filling elements, and with controlled gas paths realized in the filling elements, by means of which gas paths the individual container to be filled and located in sealed contact with a filling element can be pressurized with an inert gas at the filling pressure from the headspace of the bowl. This makes possible a removal of the inert gas displaced from the containers during the filling at least partly to the return gas duct. On the rotor for the filling elements or for each group of filling elements, at least one common additional gas duct that functions as a gas sink is provided, which is in communication by means of at least one gas connection with the headspace of the bowl, and with which the filling elements are in communication with their controlled gas paths which effect the pressurization of the containers.

The teaching of the present application is that, on the rotor of the filling machine, at least one additional gas duct is provided which functions as a gas sink and is in communication with the headspace of the bowl via a gas connection or line, and the container is pressurized with the inert gas from the additional gas duct which is at the filling pressure.

During the filling, a portion of the pressurization or inert gas displaced from the containers is returned into this additional duct which functions as a gas sink. The other part of the displaced pressurization gas goes into the return gas duct. By means of a conventional system of control of the filling elements and/or of their gas paths, and taking into consideration the gas exchange between the filling elements, it can also be essentially ensured or promoted that the quantity of inert gas that is returned to the common duct that functions as the gas sink during the filling is uniformly as large as possible, although in one possible embodiment less than the quantity of inert gas extracted from this additional duct during the pressurization of the container. Because in one possible embodiment of the present application, the quantity of gas extracted from the filling valves during the pressurization is always or substantially always greater than the quantity of inert gas discharged into the additional gas duct during the filling, there is always or substantially always a deficit of gas in the additional gas duct.

Consequently, inert gas that comprises air or oxygen from the additional duct cannot get into the headspace of the bowl. Rather, a gas flow is formed which runs out of the headspace of the bowl into the duct that functions as the gas sink. To compensate for the gas deficit and/or to maintain the filling pressure in the headspace of the bowl, a controlled quantity of inert gas is fed to this headspace.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to the present application. The present application is explained in greater detail below with reference to one possible embodiment which is illustrated in the accompanying drawings, in which:

FIG. 3 is a table showing method steps, associated valve positions, and flow conditions of an embodiment of a method for filling containers with a gas sensitive material under counterpressure.

DESCRIPTION OF EMBODIMENT OR EMBODIMENTS

Figure 1:
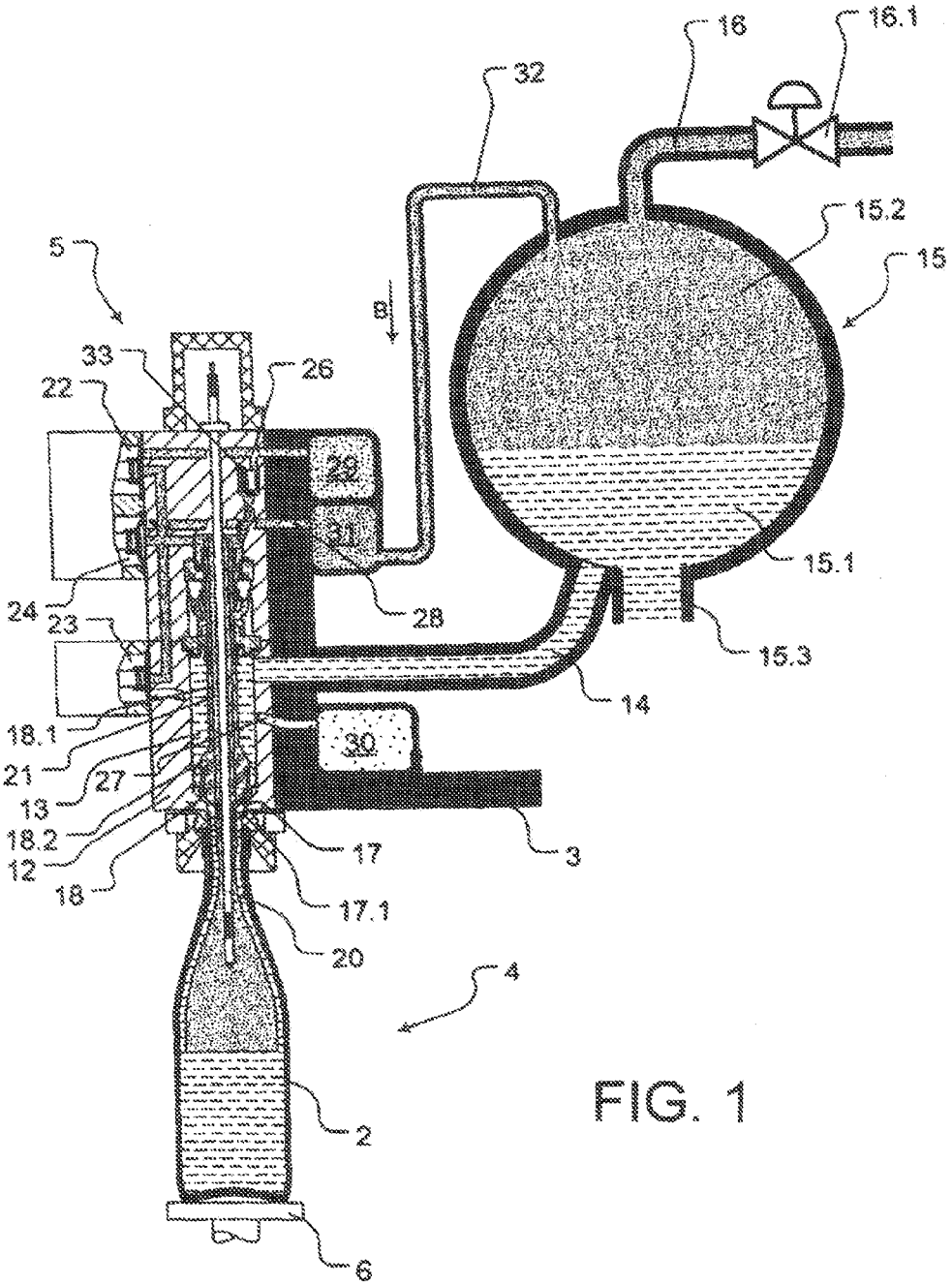
FIG. 1 is a simplified illustration of a filling element of a filling machine that employs the rotary construction for the filling of bottles or similar containers with a liquid under counterpressure.

In the figures, 1 is a filling machine for the filling of containers realized in the form of bottles 2 with a liquid that houses carbon dioxide such as beer, for example. For this purpose, the filling machine 1 has, and distributed at equal intervals on the periphery of a rotor 3 which is driven in rotation (Arrow A) around a vertical machine axis, a plurality of filling stations 4, each of which comprises a filling element 5, which does not have a filling tube in the illustrated embodiment, and a bottle or container carrier 6 which is located underneath this filling element 5 in the form of a bottle plate that can be raised and lowered in a controlled manner by a lifting device.

The bottles 2 to be filled are delivered to the filling machine 1 in the upright position in the form of a container stream 2.1 via a conveyor 7, and each container arrives individually via a container inlet 8 at one of the filling positions 4, in which the respective bottle 2 is oriented with its bottle axis in the vertical direction and standing upright on the initially lowered container carrier 6. After the respective bottle 2 with the container carrier 6 has been raised and placed in sealed contact against the filling element 5, the filling process is initiated. The filled bottles 2 are transported by an outlet or a transfer star wheel 9 to the capper 10. The filled and capped bottles 2 are transported outward by means of a machine outlet 11 on the conveyor 7.

Figure 2:
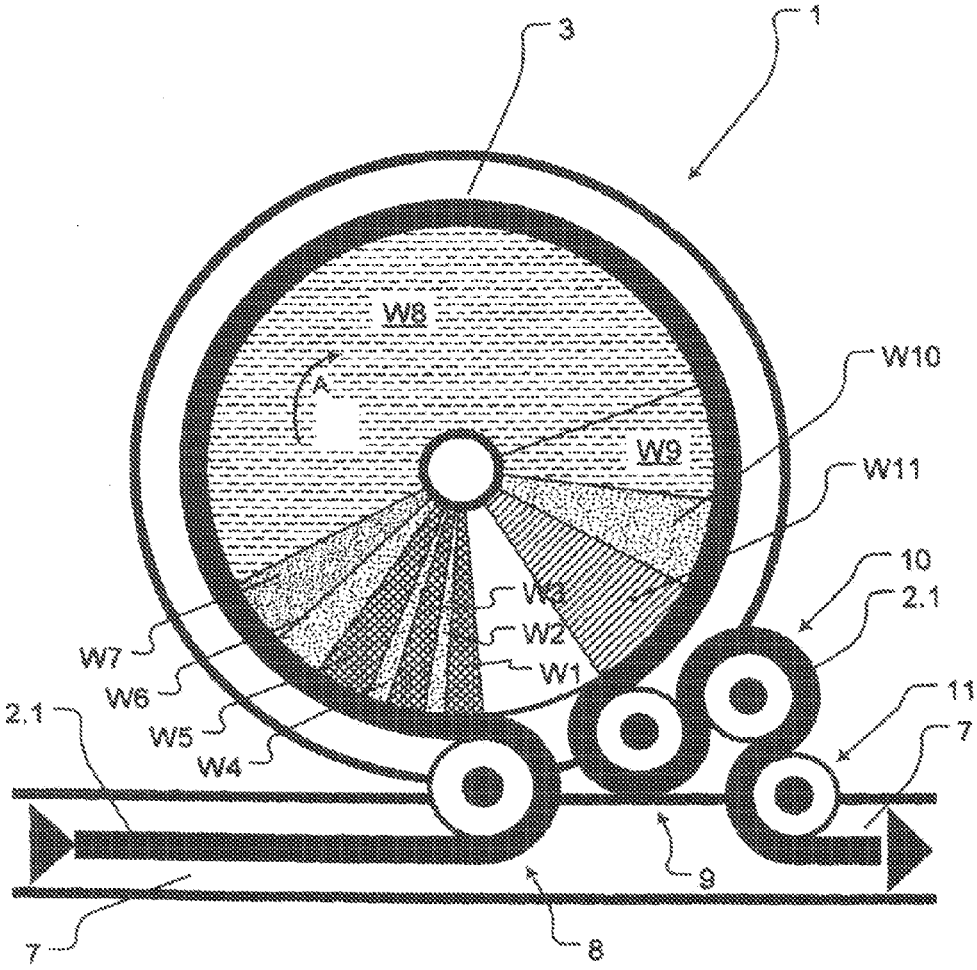
FIG. 2 is a schematic function diagram that shows a plan view of the filling machine combined with a capper or closer.

The filling process which is performed during the rotational movement (Arrow A) of the rotor in each filling position 4 comprises, as illustrated in FIG. 2, a plurality of process steps which are performed in sequence, each of which takes place in the angular sectors identified as W1 through W11 in FIG. 2 of the rotational motion of the rotor 3, and including:

W1: Evacuation or pre-evacuation of the bottles 2,

W2: First carbon dioxide purging of the bottles 2,

W3: Evacuation of the bottles 2,

W4: Second carbon dioxide purging of the bottles 2,

W5: Evacuation or final evacuation of the bottles 2,

W6: Partial pressurization of the bottles 2 with carbon dioxide,

W7: Pressurization of the bottles 2 with carbon dioxide,

W8: Filling of the bottles 2 under counterpressure (filling pressure),

W9: Low-speed and corrective filling of the bottles 2,

W10: Completion of filling, preliminary depressurization and defoaming,

W11: Final depressurization.

Basically it is also possible, for example, to perform the filling process in a simplified manner, and in one possible embodiment, for example, so that the second carbon dioxide purging (angular sector W4 and the subsequent evacuation (angular sector W5) can be omitted, and therefore the partial pressurization (angular sector W6) and the subsequent pressurization (angular area W7) occur after the first carbon dioxide purging (angular sector W2) and the subsequent evacuation (angular sector W3).

Each filling element 5 comprises a housing 12 which is fastened on the periphery of the rotor 3, in which housing 12 a liquid duct 13, among other things, is realized, which is in communication with its upper end in FIG. 1 by means of a liquid connection or line 14 with a bowl 15 which is common to the filling elements 5 of the filling machine 1. At least during the filling operation the bowl 15 is partly filled with the liquid being bottled by means of its supply connection 15.3, so that the interior of the bowl 15 has a lower portion or liquid space 15.1 which is occupied by the liquid being bottled and another partial space or headspace 15.2 above the liquid space which is occupied by the inert gas or carbon dioxide gas under pressure (filling pressure) which is supplied in a controlled manner to the headspace 15.2 via a carbon dioxide gas supply line with a control valve 16.1.

On the underside of each filling element 5, the liquid duct 13 of each filling element 5 also forms a discharge opening 17 with a seal 17.1 against which the individual bottle 2 is pressed during the filling process by the bottle carrier 6 with its bottle mouth in sealed contact. Located in the liquid duct 13 is a liquid valve 18 which is opened by means of a pneumatically controlled actuator element 19, at the beginning of the filling (angular sector W8), and at the end of the low-speed and correction filling (angular sector W9 is closed in a controlled manner, and, in one possible embodiment, as a function of the fill level by a probe 20 which extends into the individual bottle 2 during the filling process.

In a valve tappet 18.1 which also forms the valve body 18.2 of the liquid valve 18 and is connected with the actuator element 19, a gas duct 21 which is open to the discharge opening 16 and surrounds the probe 20 in a circular fashion is realized, which is a common component of a plurality of the controlled gas paths realized in the housing 12. In the illustrated embodiment, these gas paths have three control valves 22, 23 and 24, which are each closed when the system is in the non-activated status. The control valves 22 and 23 are each connected on the output side with a common gas duct 25 which is in communication with the gas duct 21. In the housing 12 of each filling element 5, gas ducts 26 through 28 are provided to realize the gas path, whereby the gas duct 26 connects the input of the control valve 22 with a rotor-side return gas duct 29, the gas duct 27 connects the input of the control valve 23 with a rotor-side vacuum duct 30 and the gas duct 28 connects the input of the control valve 24 with an additional rotor-side gas duct 31, which functions as the gas sink in the manner described in greater detail below and represents a possible feature of the filling machine 1.

The return gas duct 29, the vacuum duct 30 and the additional duct 31 are each realized in the rotor 3 in the form of ring-shaped ducts which concentrically encircle the vertical machine axis and are provided in common for the filling elements 5 of the filling machine 1.

The additional gas duct 31 is in constant or substantially constant communication via a pipeline 32, which has a volume that is very much smaller than the volume of the gas duct 31, with the headspace 15.2.

Corresponding to the filling process described above, after the individual bottle 2 to be filled and located in a filling position 4 has been raised and brought into sealed contact with the filling element 5, the interior of the bottle is evacuated. For this purpose, with the liquid valve 18 closed, the control valve 23 is opened and the interior of the bottle 2 in question is placed in communication with the vacuum duct 30 by means of the filling-element-side gas ducts 21, 25, and 27.

After this preliminary evacuation, with the control valve 23 closed again, the interior of the bottle is purged with inert gas or carbon dioxide, and in one possible embodiment from the rotor-side return gas duct 29 by opening the control valve 22, so that the interior of the bottle 2 in question is placed in communication via the filling-element-side gas ducts 21, 25 and 26 with this return gas duct 29. The inert gas purging from the return gas duct 29 is possible because, as a result of the gas exchange between the filling elements 5, sufficient carbon dioxide gas under pressure is available in the return gas duct 29, which is displaced out of the bottle 2 during the main filling, the low-speed filling and the correction filling and into the return gas duct 29.

After the carbon dioxide purging, with the control valve 22 closed, the interior of the bottle is flushed once again by opening the control valve 23. After this process step, it is then possible to initiate the partial pressurization (angular sector W6) and the subsequent pressurization (angular sector W7), for example. In one possible embodiment, however, first there is an additional carbon dioxide purging of the interior of the bottle from the return gas duct 29 by opening the control valve 22 and then, with the control valve 22 closed again, re-evacuating the interior of the bottle by opening the control valve 23.

The partial pressurization is also performed from the return gas duct 29 by opening the control valve 22, while the final pressurization of the interior of the individual bottle to the filling pressure that is present in the bowl 15 can then be done from the additional duct 31 by opening the control valve 24.

For the subsequent filling, with the control valve 24 open, the liquid valve 18 is opened so that the liquid being bottled flows out of the liquid space 15.1 via the liquid connection 14, the liquid duct 13 and the dispensing opening 17 to the interior of the bottle 2 in question. During this process, the carbon dioxide gas displaced from the bottle 2 by the incoming liquid is partly displaced into the additional gas duct 31, although the majority of the displaced carbon dioxide gas is displaced via the throttled gas connection 33 into the return gas duct 29.

For the low-speed and corrective filling steps that end the filling process, the control valve 24 is closed so that the carbon dioxide gas that is displaced from the bottle 2 by the liquid that is now flowing into the bottle in a throttled manner flows into the return gas 29 via a gas connection 33 which is also realized in the housing 12 of each filling element 5, is throttled and is provided with a non-return valve. The low-speed and corrective filling steps are terminated by closing the liquid valve 18. This step is followed by the depressurization, defoaming and final depressurization.

Because the bottle 2 is pressurized from the additional gas duct 31 and a majority of the quantity of carbon dioxide gas which is displaced by the incoming liquid being bottled out of the interior of the individual bottle during the filling and during the low-speed and corrective filling steps travels into the return gas duct 29, there is a deficit of carbon dioxide gas in the additional gas duct 31 as well as in the bowl 15, which is made up in a controlled manner via the line 16. That means in one possible embodiment that a permanent or substantially permanent carbon dioxide gas flow in the line 32 from the headspace 15.2 into the gas duct 31 is realized, and thus carbon dioxide gas comprising portions of air and/or oxygen displaced from the bottle 2 during the filling can travel into the relatively large-volume gas duct 31, but not via the line 32 into the headspace 15.2 of the bowl 15. As a result, the absorption of oxygen at the boundary surface between the liquid being bottled and the carbon dioxide atmosphere, i.e. at the boundary surface between the liquid space 15.1 and the headspace 15.2 in the bowl 15, is effectively prevented, restricted, and/or minimized, as a result of which the oxygen content in the liquid being bottled in the bottles 2 is significantly reduced, and consequently the shelf life and quality of the product are significantly improved.

The present application was described above on the basis of one possible embodiment. It goes without saying that modifications and variations can be made without thereby going beyond the teaching of the present application.

For example, the additional duct 31 and/or the connecting line 32 can be connected by means of an additional closable gas duct directly with the return gas duct 29. In at least one possible embodiment according to the present application, if there are interruptions in the feed of bottles to the filling machine, because it can happen in such a case that the gas supply available from the actual filling processes in the additional duct 31 exceeds the demand for gas from the purging and pressurization processes, as a result of which excess gas could get into the bowl 15. As a result of the gas path according to the present application, which can be closed by a controllable valve, for example, between the additional duct 31 and the return gas duct 29, in such a situation excess gas is conducted from the additional duct 31 directly into the return gas duct 29, as a result of which a backflow of gas comprising oxygen into the bowl 15 is reliably or substantially reliably prevented, restricted, and/or minimized.

Figure 1A:
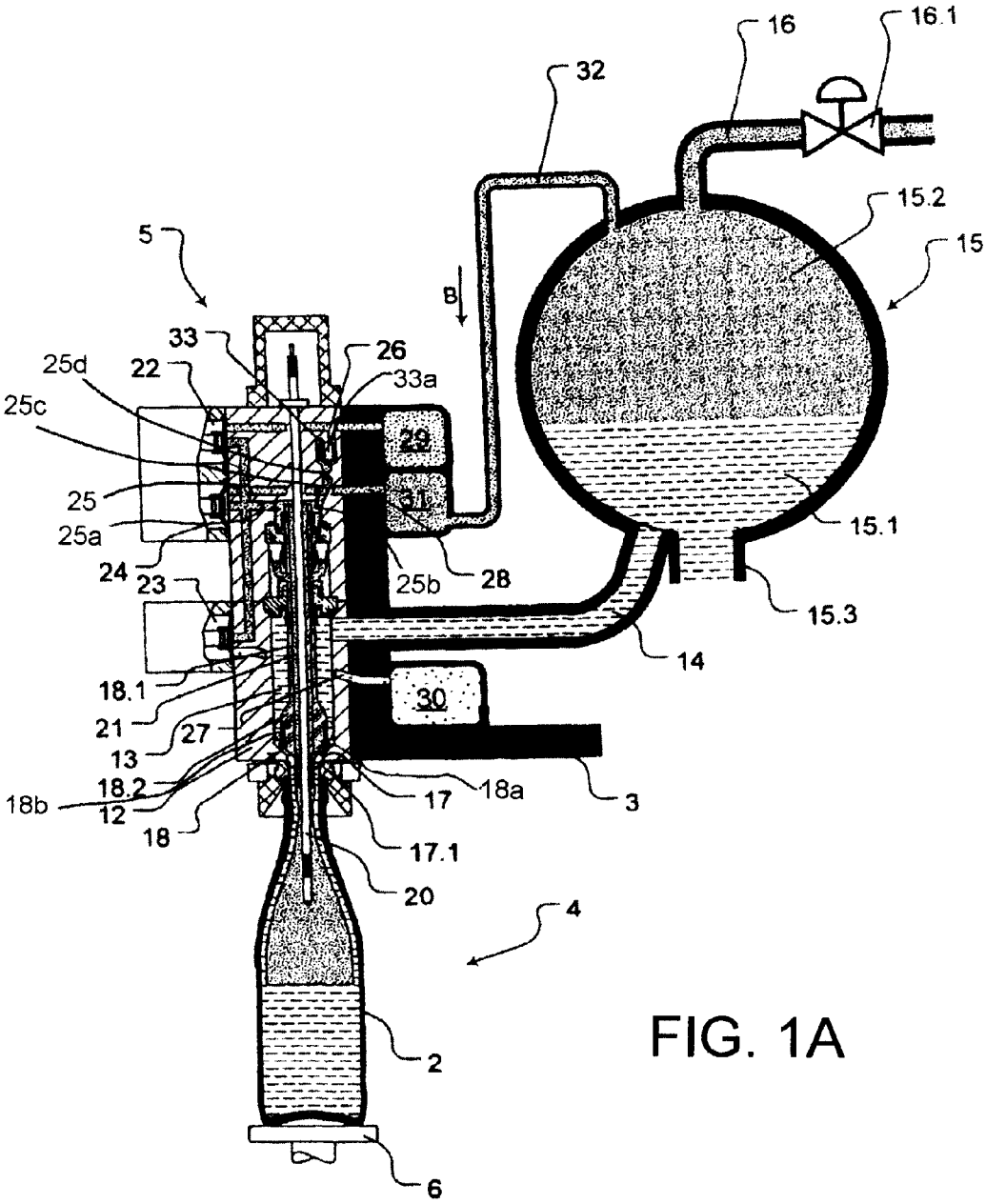
FIG. 1A is a simplified illustration of a filling element of a filling machine that employs the rotary construction for the filling of bottles or similar containers with a liquid under counterpressure.
Figure 1B:
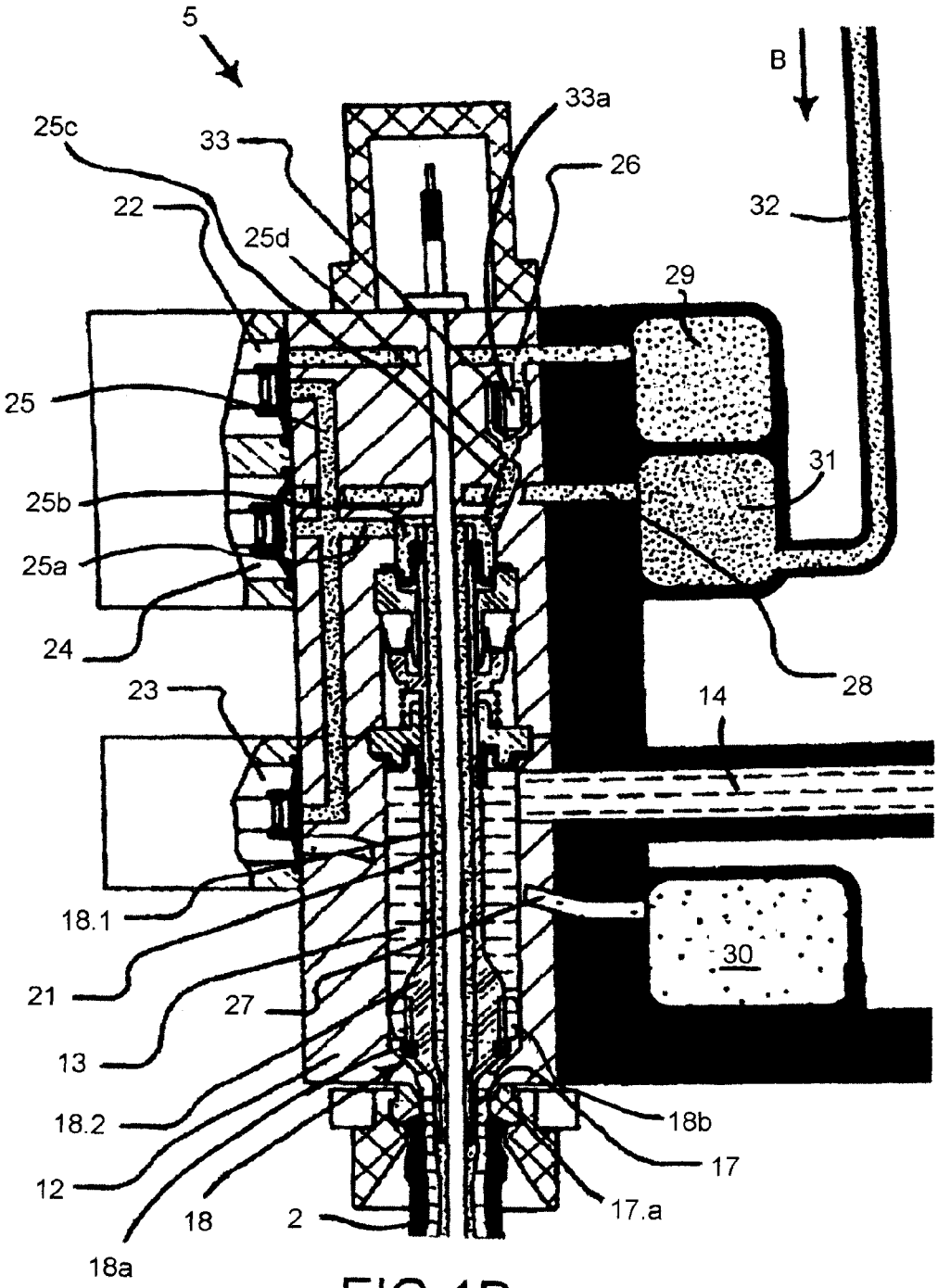
FIG. 1B is a section of FIG. 1B showing details of a simplified illustration of a filling element of a filling machine.

FIGS. 1A and 1B show gas and liquid flow ducts and valves of filling element 5. Control valves 22, 23, and 24 provide control of gas flow within bottle 2 and filling element 5. Control valve 22 controls the communication between return gas duct 29, via gas duct 26, and gas duct 25. Gas duct 25 is in communication with control valves 22, 23, and 24 and gas duct 25*a*. Gas duct 25*a* provides the flow of gas between gas duct gas duct 21, which is in flow communication with bottle 2, and gas duct 25*a* through gas duct 25*b*. Control valve 23 controls the communication between vacuum duct 30 and gas duct 25. Control valve 24 controls the communication between additional duct or gas sink or gas chamber 31 and gas duct 25 through gas duct 28. In short, control valve 22 controls the flow communication between return gas duct 29 and bottle 2, control valve 23 controls the flow communication between vacuum duct 30 and bottle 2, and control valve 24 controls the flow communication between additional duct or gas sink 31 and bottle 2. A process for filling bottles is now described with reference to FIG. 2B. The table shown in FIG. 3 summarizes valve control and the flow of liquids and carbon dioxide for steps taken in at least one embodiment of a method for filling beverage bottles with a liquid beverage filling material under counterpressure.

Each bottle 2 may first be evacuated by first closing liquid valve 18. Control valves 22 and 24 are closed and control valve 23 is opened, providing flow communication between vacuum duct 30 and bottle 2 through gas ducts 27, 25, 25*a*, 25*b*, and 21.

After evacuation, bottle 2 may be purged with carbon dioxide. Carbon dioxide is stored in return gas duct 29 and is primarily supplied by gas displaced during filling of bottles 2 but may also be supplied by gas sink 31 via connecting line 32 at a bottling pressure. The purging of bottles 2 comprises closing valves 23 and 24 and opening control valve 22. In this configuration, the interior of the bottle 2 is placed in flow communication with return gas duct 29 through gas ducts 21, 25*b*, 25*a*, 25 and 26. The evacuation and purging steps may be repeated to obtain a desired purity of carbon dioxide in bottle 2.

A final pressurization of bottle 2 may be done by closing control valves 22 and 23 and opening control valve 24, allowing carbon dioxide to flow from gas sink or gas chamber 31. Gas sink or chamber 31 has carbon dioxide maintained proximate a bottling pressure through connecting line 32.

Bottle 2 is then filled with liquid through liquid connection 14. To fill bottle 2 with a liquid, gas control valves 22 and 23 are closed and control valve 24 is opened. In this configuration, gas sink 31 is in flow communication with bottle 2. Liquid valve 18 is then opened to allow liquid to flow through liquid connection 14 and liquid duct 13 into bottle 2.

During filling, carbon dioxide is displaced from the interior of bottle 2. This displaced carbon dioxide enters gas duct 21 and flows into gas duct 25*b*. Gas duct 25*b* is in flow communication with gas ducts 21, 25*a*, and 25*c*. The gas flows into gas duct 25*b* from gas duct 21 since bottle 2 is at or above a bottling pressure. A significant portion of the gas flows from 25*b* into return gas duct 29 through gas duct 25*c* since gas duct 29 may be below a bottling pressure. Gas duct 25*c* has flow restrictor 25*d* and one way valve 33 regulating the flow of carbon dioxide into return gas duct 29 through gas duct 26. This regulation of flow of the carbon dioxide into return gas duct 29 may form a backpressure proximate flow restrictor 25*d*, increasing the pressure of carbon dioxide in gas duct 25*c* above the carbon dioxide pressure in gas sink 31. Having gas control valve 24 open provides flow communication between gas duct 25*b* and gas sink 31 through gas ducts 25*a*, 25, and 28. Therefore, a portion of the gas displaced from bottle 2 during filling may enter gas sink 31. In at least one embodiment, the volume of gas sink 31 is sufficient to contain the displaced gas fed thereto. In at least one embodiment the volume of gas sink 31 is larger than the volume of gas duct 32. Gas duct 32 is in flow communication with the head space 15.2 of liquid space 15.1. Having a volume of gas sink 31 sufficient to hold the displaced carbon dioxide fed thereto prevents most all of the displaced gas to enter head space 15.2, keeping head space 15.2 substantially free of oxygen.

A final or corrective filling of bottle 2, filling bottle 2 to a desired level, may be accomplished by closing control valve 24. With control valve 24 closed, the carbon dioxide is displaced into return gas duct 29 through gas duct 25*c*. At the end of the final filling, return gas duct 29 may be proximate a bottling pressure.

In at least one embodiment, the quantity of carbon dioxide exiting gas sink 31, during a final carbon dioxide pressurization of bottle 2, is greater than the amount of carbon dioxide entering gas sink 31 during the liquid filling of bottle 2 with liquid through liquid duct 13. In this embodiment, the carbon dioxide displaced during filling, with control valve 24 open, fills gas ducts 21, 25*b*, 25*a*, 25, and 25*c*. Since return duct 29 is below a bottling pressure, from purging, at the beginning of the filling step a majority of carbon dioxide displaced by the liquid in bottle 2 flows into return gas duct 29. However, throttled gas connection 33 and/or flow restrictor 25*d* may create sufficient head pressure to divert a portion into gas sink 31. Yet, the volume of gas sink 31 is large enough to hold the carbon dioxide flowing into gas sink 31 to avoid displaced carbon dioxide from entering connecting line 32. Further, the volume of gas sink 31 may not be too large so that gas sink 31 is substantially filled with carbon dioxide from connecting line 32, during the final pressurization step.

In at least one embodiment, gas sink 31 is large enough to hold a portion of displaced gas from bottle 2, which may be contaminated with oxygen, and small enough to be substantially flushed of oxygen for each bottle 2 being filled in a filling run. This sizing of gas sink 31 preventing or minimizing oxygen from entering connecting line 32 and head space 15.2 during a filling run of bottles 2.

A first evacuation step of bottle 2 comprises opening valve 23, evacuating the oxygen in the bottle to vacuum duct 30. Bottle 2 is then filled with gas, such as carbon dioxide which may be contaminated with oxygen, from return duct 29, by opening valve 22. The evacuation and gas filling of bottle 2 may be repeated until the oxygen concentration in bottle 2 is lowered to about the oxygen concentration in return duct 29. The pressure in bottle 2 and return duct 29 are below a bottling pressure after the evacuation and gas filling steps. Prior to liquid filling of bottle 2, a final pressurization of bottle 2 brings it up to approximately the bottling pressure. The final pressurization of bottle 2 comprises opening valve 24 and pressurizing bottle 2 with the gas in gas sink 31. The volume of gas sink 31 is small enough so that most all of the oxygen introduced into gas sink 31, during liquid filling, is displaced with makeup carbon dioxide from connecting line 32.

During liquid filling of bottle 2, valves 18 and 24 are opened and the head pressure of the liquid being introduced into bottle 2, through valve 18, forces the gas into return duct 29 and gas sink 31. The gas displaced from bottle 2 may be contaminated with oxygen. Since the pressure in return duct 29 is below a bottling pressure, most or a substantial portion of the displaced gas flows into return duct 29. However, a portion of the displaced gas is diverted to gas sink 31 with flow restrictor 25*d* and throttled gas connection 33. Gas sink 31 is large enough to contain the displaced gas diverted thereto. In this respect, almost none or a very small portion or an amount that will not effect the shelf life of the beverage, of the oxygen contaminated gas, from bottle 2, enters connecting line 32 and therefore keeps liquid 15.1 and head space 15.2 relatively free of oxygen. A corrective filling of bottle 2, with valves 22, 23, and 24 closed forces displaced gas into return duct 29 and brings return duct 29 approaching a bottling pressure. Filling element 5 is now ready to receive the next bottle of a filling run. Optionally, valve 24 may be opened to deliver gas from gas sink 31 to gas duct 29 through gas ducts 28, 25*a*, 25*b*, 25*c*, flow restrictor 25*d*, and throttled gas connection 33. This may be done prior to filling a first bottle 2, in a run of bottles 2, or anytime it is desired to bring gas duct 29 up to a pressure approaching a bottling pressure.

In at least one embodiment, the volume of ducts 21, 25*b*, 25*c*, 25*a*, 26, 28, are minimal as compared to the volume of gas sink 31. In this respect, gas sink 31 serves to achieve a low consumption of carbon dioxide, in an economical manner, and avoid, restrict, and/or minimize the absorption of oxygen by liquid 15.1 in bowl or reservoir 15. The minimization of absorption of oxygen by liquid 15.1 may be highly desirable when filling bottles 2 with an oxygen sensitive beverage. For example, the liquid 15.1 may be a non-pasturized beverage that may require aseptic filling.

In at least one other embodiment, flow restrictor 25*d* and throttled gas connection 33 are configured to divert gas displaced from bottle 2, during filling, in an amount that does not exceed the volume of gas sink 31. For example, flow restrictor 25*d* may have a diameter configured to divert a portion of the gas being displaced from bottle 2 during spikes in gas pressure to gas sink 31. Also, throttle gas connection 33 may comprise a weight 33*a* configured to create a back pressure within gas duct 25*c*. Weight 33*a* may be configured to provide a threshold pressure that lifts weight 33*a* and provides flow of gas from gas duct 25*b* to return gas duct 29. In this embodiment, weight 33*a* also substantially prevents backflow from gas sink 29 through gas duct 25*c*. Weight 33*a* may have a desired weight for diverting a desired amount of displaced gas to gas sink 31. The threshold pressure created by weight 33*a* may provide for a desired pressure difference between gas sink 31 and gas return 29, thus almost eliminating or minimizing an amount of oxygen entering connecting line 32 during a bottle filling run.

FIG. 1*b* may show gas and liquid flow ducts and valves of filling element 5. Control valves 22, 23, and 24 may possibly provide control of gas flow within bottle 2 and filling element 5. Control valve 22 may control the communication between return gas duct 29, via gas duct 26, and gas duct 25. Gas duct 25 may be in communication with control valves 22, 23, and 24 and gas duct 25*a*. Gas duct 25*a* may provide the flow of gas between gas duct 21, which is in flow communication with bottle 2, and gas duct 25*a* through gas duct 25*b*. Control valve 23 may control the communication between vacuum duct 30 and gas duct 25. Control valve 24 may control the communication between additional duct or gas sink 31 and gas duct 25 through gas duct 28. In short, control valve 22 may control the flow communication between return gas duct 29 and bottle 2, control valve 23 may control the flow communication between vacuum duct 30 and bottle 2, and control valve may control the flow communication between additional duct or gas sink 31 and bottle 2. A process for filling bottles is now described with reference to FIG. 2*b*.

Each bottle 2 may first be evacuated by first closing liquid valve 18. Control valves 22 and 24 may be closed and control valve 23 may be opened, possibly providing flow communication between vacuum duct 30 and bottle 2 through gas ducts 27, 25, 25*a*, 25*b*, and 21.

After evacuation, bottle 2 may be purged with carbon dioxide. carbon dioxide may be stored in return gas duct 29 and is may be primarily supplied by gas displaced during filling of bottles 2 but may also be supplied by gas sink 31 via connecting line 32 at a bottling pressure. The purging of bottles 2 may comprise closing valves 23 and 24 and opening control valve 22. In this configuration, the interior of the bottle 2 may be placed in flow communication with return gas duct 29 through gas ducts 21, 25*b*, 25*a*, 25 and 26. The evacuation and purging steps may be repeated to obtain a desired purity of carbon dioxide in bottle 2.

A final pressurization of bottle 2 may be done by closing control valves 22 and 23 and opening control valve 24, allowing or possibly permitting carbon dioxide to flow from gas sink 31. Gas sink 31 has carbon dioxide maintained proximate a bottling pressure through connecting line 32. In other words, the gas sink 31 may possibly permit carbon dioxide to be kept at a desired bottling pressure through the connecting line 32.

Bottle 2 may then be filled with liquid through liquid connection 14. To fill bottle 2 with a liquid, gas control valves 22 and 23 may be closed and control valve 24 may be opened. In this configuration, gas sink 31 may be in flow communication with bottle 2. Liquid valve 18 may then be opened to allow or permit liquid to flow through liquid connection 14 and liquid duct 13 into bottle 2.

During filling, carbon dioxide may be displaced from the interior of bottle 2. This displaced carbon dioxide may enter gas duct 21 and may flow into gas duct 25*b*. Gas duct 25*b* may be in flow communication with gas ducts 21, 25*a*, and 25*c*. The gas may flow into gas duct 25*b* from gas duct 21 since bottle 2 may be at or above a bottling pressure. A portion of the gas may flow from 25*b* into return gas duct 29 through gas duct 25*c* since gas duct 29 may be below a bottling pressure. Gas duct 25*c* may have a flow restrictor 25*d* and one way valve 33 regulating the flow of carbon dioxide into return gas duct 29 through gas duct 26. This regulation of flow of the carbon dioxide into return gas duct 29 may form a backpressure proximate flow restrictor 25*d*, possibly increasing the pressure of carbon dioxide in gas duct 25*c* above the carbon dioxide pressure in gas sink 31. Having gas control valve 24 open provides or possibly permits flow communication between gas duct 25*b* and gas sink 31 through gas ducts 25*a*, 25, and 28. Therefore, a portion of the gas displaced from bottle 2 during filling may possibly enter gas sink 31. In at least one possible embodiment, the volume of gas sink 31 may be sufficient to house the displaced gas fed thereto. In at least one possible embodiment, the volume of gas sink 31 may be larger than the volume of gas duct 32. Gas duct 32 may be in flow communication with the head space 15.2 of liquid space 15.1. Having a volume of gas sink 31 sufficient to hold the displaced carbon dioxide fed thereto prevents, restricts, and/or minimizes the displaced gas to enter head space 15.2, possibly keeping head space 15.2 substantially free of oxygen.

A final or corrective filling of bottle 2, filling bottle 2 to a desired level, may be accomplished by closing control valve 24. With control valve 24 closed, the carbon dioxide may be displaced into return gas duct 29 through gas duct 25*c*. At the end of the final filling, return gas duct 29 may possibly be proximate a bottling pressure.

In at least one possible embodiment, the quantity of carbon dioxide exiting gas sink 31, during a final carbon dioxide pressurization of bottle 2, may be greater than the amount of carbon dioxide entering gas sink 31 during the liquid filling of bottle 2 with liquid through liquid duct 13. In this embodiment, the carbon dioxide displaced during filling, with control valve 24 open, may fill gas ducts 21, 25*b*, 25*a*, 25, and 25*c*. Since return duct 29 may be below a bottling pressure, from purging, at the beginning of the filling step a majority of carbon dioxide displaced by the liquid in bottle 2 may flow into return gas duct 29. However, throttled gas connection 33 and/or flow restrictor 25*d* may possibly create sufficient head pressure to divert a portion into gas sink 31. Yet, the volume of gas sink 31 may be large enough to hold the carbon dioxide flowing into gas sink 31 to avoid, restrict, and/or minimize displaced carbon dioxide from entering connecting line 32. Further, the volume of gas sink 31 may not be too large so that gas sink 31 is substantially filled with carbon dioxide from connecting line 32, during the final pressurization step.

Gas sink 31 may be large enough to hold a portion of displaced gas from bottle 2, which may be contaminated with oxygen, and small enough to possibly be substantially flushed of oxygen for each bottle 2 being filled in a filling run. This sizing of gas sink 31 preventing, restricting, and/or minimizing oxygen from entering connecting line 32 and head space 15.2 during a filling run of bottles 2.

A first evacuation step of bottle 2 may comprise opening valve 23, evacuating the oxygen in the bottle to vacuum duct 30. Bottle 2 may then be filled with gas, carbon dioxide which may be contaminated with oxygen, from return duct 29, by opening valve 22. The evacuation and gas filling of bottle 2 may be repeated until the oxygen concentration in bottle 2 may possibly be lowered to about the oxygen concentration in return duct 29. The pressure in bottle 2 and return duct 29 may be below a bottling pressure after the evacuation and gas filling steps. Prior to liquid filling of bottle 2, a final pressurization of bottle 2 may bring it up to approximately the bottling pressure. The final pressurization of bottle 2 may comprise opening valve 24 and pressurizing bottle 2 with the gas in gas sink 31. The volume of gas sink 31 may possibly be small enough so that most all or a substantial portion of the oxygen introduced into gas sink 31, during liquid filling, may be displaced with makeup carbon dioxide from connecting line 32.

During liquid filling of bottle 2, valves 18 and 24 may be opened and the head pressure of the liquid being introduced into bottle 2, through valve 18, may force the gas into return duct 29 and gas sink 31. The gas displaced from bottle 2 may be contaminated with oxygen. Since the pressure in return duct 29 is below a bottling pressure, most or substantially most of the displaced gas may flow into return duct 29. However, a portion of the displaced gas may be diverted to gas sink 31 with flow restrictor 25*d* and throttled gas connection 33. Gas sink 31 may possibly be large enough to house the displaced gas diverted thereto. In this respect, almost none or a small portion of the oxygen contaminated gas, from bottle 2, may enter connecting line 32 and therefore may keep liquid 15.1 and head space 15.2 relatively free of oxygen. A corrective filling of bottle 2, with valves 22, 23, and 24 closed, may force displaced gas into return duct 29 and may bring return duct 29 approaching a bottling pressure. Filling element 5 may now be ready to receive the next bottle of a filling run. Optionally, valve 24 may be opened to deliver gas from gas sink 31 to gas duct 29 through gas ducts 28, 25*a*, 25*b*, 25*c*, flow restrictor 25*d*, and throttled gas connection 33. This may possibly be done prior to filling a first bottle 2, in a run of bottles 2, or anytime it may be desired to bring gas duct 29 up to a pressure approaching a bottling pressure.

In at least one embodiment, the volume of ducts 21, 25*b*, 25*c*, 25*a*, 26, 28, may be minimal as compared to the volume of gas sink 31. In this respect, gas sink 31 may serve to achieve a low consumption of carbon dioxide, in an economical manner, and avoid, restrict, and/or minimize the absorption of oxygen by liquid 15.1 in bowl 15. The minimization of absorption of oxygen by liquid 15.1 may be highly desirable when filling bottles 2 with an oxygen sensitive beverage. For example, the liquid 15.1 may be a non-pasturized beverage that may require aseptic filling.

In at least one other embodiment, flow restrictor 25*d* and throttled gas connection 33 may be configured to divert gas displaced from bottle 2, during filling, in an amount that does not exceed the volume of gas sink 31. For example, flow restrictor 25*d* may have a diameter configured to divert a portion of the gas being displaced from bottle 2 during spikes in gas pressure to gas sink 31. Also, the weighted throttle in throttled gas connection 33 may have a desired weight for diverting a desired amount of displaced gas to gas sink 31.

In at least one embodiment, the filling is controlled as a function of the level of the liquid, and for this purpose each filling element 5 of the filling machine has a probe 20 that determines the filling level and during the filling process extends with its probe tip into the respective bottle 2. Probe 20 may be an electronic sensing probe, a float probe, or other type of probe as is known in the art for sensing the liquid level in a container. Liquid valve 18 may be controlled in response to the liquid level sensed with probe 20 in the bottle 2 being filled.

In at least one embodiment, to prevent the liquid flowing into the bottle 2 to splash or otherwise form bubbles may interfere with sensing by probe 20 or may cause the liquid effervescent beverage to absorb oxygen, a swirling mechanism is provided. Guide elements 18*b* may be provided for the liquid, generally these devices may be referred to as screens or shields. Guide elements 18*b* may be located on the external contour of the valve body 18.2 and may be configured to deflect the liquid and steer it toward the bottle 2 wall in a swirling motion. For example, guide elements 18*b* may be swirl inserts or torsion bodies and may be located inside the liquid path and impart a rotational motion to the liquid, as a result of which the liquid flows into bottle 2 in contact with the inside wall of the bottle 2 by centrifugal force. A swirl effect of the liquid may be realized with a swirler 18*b* in the form of a flat, plane element. In at least one possible embodiment, the liquid beverage is swirled into the bottles or containers 2 to cause the liquid to travel across at least a substantial portion of the interior surface of the bottles. A seal 18*a* may be located proximate guide elements 18*b* to effectuate sealing with liquid valve 18.

Figure 4:
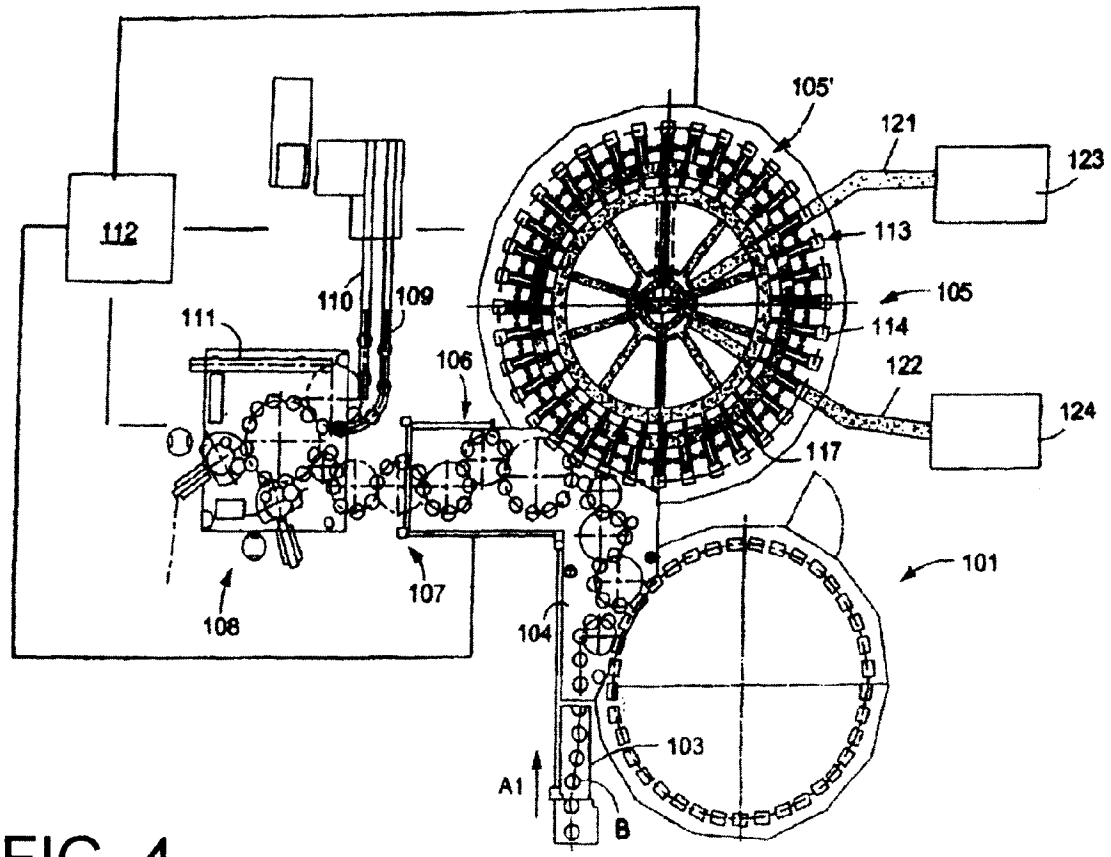
FIG. 4 shows schematically the main components of one possible embodiment example of a system for filling containers.

FIG. 4 shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 4 shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 4, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The description presented above refers exclusively to filling systems which purge the containers to be filled at least once before the actual filling to replace any air that comprises oxygen in the containers with an inert gas. On account of the number of process steps required and/or desired and the technical complexity, this application presents the most challenging technical requirements that are met by this present application. It goes without saying that this present application can also be used for filling systems that omit purging of the containers.

One feature or aspect of an embodiment is believed at the time of the filing of this patent application to possibly reside broadly in a method for filling bottles or similar containers 2 with a liquid under counterpressure, using a filling machine 1 which has, on a rotor 3 a plurality of filling elements 5, a bowl 15 that is common to the filling elements 5, whereby the interior of the bowl 15 forms a liquid space 15.1 which is occupied by the liquid being bottled and a headspace 15.2 above the liquid for an inert gas under pressure (filling pressure), and at least one return gas duct which is common to the filling elements 5 or to each of a group of filling elements 5, whereby before the filling, the interior of the container 2 is pressurized by means of a controlled gas path 21, 24, 28 of each filling element with inert gas originating from the headspace 15.2 of the bowl 15 and at the filling pressure, and during the filling at least some of the inert gas is displaced from the containers 2 by the incoming liquid into the at least one return gas duct 29, wherein the individual container 2 is pressurized from at least one additional gas duct 31 that functions as a gas sink and is common to the filling element 5 or a group of filling elements 5, which additional gas duct 31 is connected by means of at least one gas connection 32 to the headspace 15.2 of the bowl 15.

Another feature or aspect of an embodiment is believed at the time of the filing of this patent application to possibly reside broadly in the method, wherein at least the pressurization of the containers 2 and the filling of the containers are performed under counterpressure by controlling the gas paths of the filling elements 5 such that, taking into consideration a gas exchange between the filling elements 5, the quantity of inert gas taken from the additional gas duct 31 during the pressurization is greater than the quantity of gas displaced from the bottles 2 into this additional gas duct 31 during the filling under counterpressure.

Yet another feature or aspect of an embodiment is believed at the time of the filing of this patent application to possibly reside broadly in the method, wherein inert gas is fed in a controlled manner to the headspace 15.2 of the bowl 15 to maintain the filling pressure.

Still another feature or aspect of an embodiment is believed at the time of the filing of this patent application to possibly reside broadly in the method, wherein the additional gas duct 31 that functions as a gas sink has a volume which is significantly greater than the volume of the rotor-side gas connection 32 that connects this gas duct 31 with the headspace 15.2 of the bowl 15.

A further feature or aspect of an embodiment is believed at the time of the filing of this patent application to possibly reside broadly in the method, wherein the containers 2 are pressurized exclusively from the additional gas duct 31 that functions as a gas sink.

Another feature or aspect of an embodiment is believed at the time of the filing of this patent application to possibly reside broadly in the method, wherein during the filling of the containers 2, some of the inert gas is also displaced by means of a controlled gas path 21, 24, 28 of each filling element into the additional gas duct 31 that functions as the gas sink.

Yet another feature or aspect of an embodiment is believed at the time of the filing of this patent application to possibly reside broadly in the method, wherein the pressurization is preceded by a partial pressurization of the containers 2 by means of a controlled gas path 21, 22, 26 of the individual filling element 5 from the return gas duct 29.

Still another feature or aspect of an embodiment is believed at the time of the filing of this patent application to possibly reside broadly in the method, wherein before the pressurization or before the partial pressurization, there is at least one purging of the containers 2 via controlled gas paths 21, 22, 26 of the filling elements 5 with inert gas.

A further feature or aspect of an embodiment is believed at the time of the filing of this patent application to possibly reside broadly in the method, wherein the container 2 is flushed with inert gas from the return gas duct 29.

Another feature or aspect of an embodiment is believed at the time of the filing of this patent application to possibly reside broadly in the method, wherein before and/or after the purging via controlled gas paths 21, 23, 27 of the filling elements 5, the container 2 which is in sealed contact with the respective filling element 5 is evacuated.

Yet another feature or aspect of an embodiment is believed at the time of the filing of this patent application to possibly reside broadly in the method, wherein carbon dioxide gas is used as the inert gas.

Still another feature or aspect of an embodiment is believed at the time of the filing of this patent application to possibly reside broadly in the method, wherein under certain operating conditions, return gas can be conducted by means of a controlled gas path from the additional duct 31 to the return gas duct 29 or from the connecting line 32 to the return gas duct 29.

A further feature or aspect of an embodiment is believed at the time of the filing of this patent application to possibly reside broadly in the method, wherein there is at least a one-time evacuation or purging of the container prior to the filling of the container.

One feature or aspect of an embodiment is believed at the time of the filing of this patent application to possibly reside broadly in a filling machine with a rotary construction for the filling of bottles or similar containers 2 with a liquid under counterpressure, with a bowl 15 which is provided on a rotor 3 that can be driven in rotation around a vertical machine axis, whereby the interior of the bowl 15 forms a liquid space 15.1 which is occupied by the liquid being bottled and a headspace 15.2 above the surface of the liquid being bottled for an inert gas under pressure (filling pressure), with a plurality of filling elements 5 located on the periphery of the rotor 3, each of which has a fluid duct 13 which is in communication with the liquid space 15.1 of the bowl 15 and a discharge opening 17 with a controlled liquid valve 18, with at least one common return gas duct 29 on the rotor which is common to the filling elements 5 or a group of filling elements 5, and with controlled gas paths 21, 22, 26; 21, 23, 27; 21, 24, 28 realized in the filling elements 5, by means of which gas paths the individual container 2 to be filled and located in sealed contact with a filling element 5 can be pressurized with an inert gas at the filling pressure from the headspace 15.2 of the bowl 15, and which makes possible a removal of the inert gas displaced from the containers 2 during the filling at least partly to the return gas duct 29, wherein on the rotor 3 for the filling elements 5 or for each group of filling elements 5 at least one common additional gas duct 31 that functions as a gas sink is provided, which is in communication by means of at least one gas connection 32 with the headspace 15.2 of the bowl, and with which the filling elements 5 are in communication with their controlled gas paths 21, 24, 28 which effect the pressurization of the containers 2.

Another feature or aspect of an embodiment is believed at the time of the filing of this patent application to possibly reside broadly in the filling machine, wherein the additional gas duct 31 that functions as a gas sink has a volume which is greater than the total volume of the rotor-side gas connection 23 which connects this gas duct 31 with the headspace 15.2 of the bowl 15.

Yet another feature or aspect of an embodiment is believed at the time of the filing of this patent application to possibly reside broadly in the filling machine, wherein the at least one additional gas duct 31 is in constant or substantially constant communication with the headspace 15.2 of the bowl 15.

Still another feature or aspect of an embodiment is believed at the time of the filing of this patent application to possibly reside broadly in the filling machine, comprising means 16, 16.1 for the controlled feeding of inert gas into the headspace 15.2 of the bowl 15 for the maintenance of the filling pressure.

A further feature or aspect of an embodiment is believed at the time of the filing of this patent application to possibly reside broadly in the filling machine, wherein on the rotor 3, at least one vacuum duct 30 which is common to the filling elements 5 or to a group of filling elements 5 is provided, to which the filling elements 5 are connected with at least one controlled gas path 21, 23, 27 which is realized in the filling elements 5.

Another feature or aspect of an embodiment is believed at the time of the filing of this patent application to possibly reside broadly in the filling machine, wherein one gas duct 21 is common to the gas paths realized in each filling element 5, which gas duct 21 empties into the interior of the container that is located in sealed contact with the related filling element 5.

Yet another feature or aspect of an embodiment is believed at the time of the filing of this patent application to possibly reside broadly in the filling machine, wherein the discharge opening 17 of each filling element 5 is realized in the form of a ring or partial ring so that it encircles a container-side opening of the gas duct 21 which is common to the gas paths.

Still another feature or aspect of an embodiment is believed at the time of the filing of this patent application to possibly reside broadly in the filling machine, wherein the filling elements 5 are filling elements without filler tubes.

A further feature or aspect of an embodiment is believed at the time of the filing of this patent application to possibly reside broadly in the filling machine, wherein there is a controllable connecting line between the additional duct 31 and the return gas duct 29 and/or the connecting line 32 and the return gas duct 29.

Another feature or aspect of an embodiment is believed at the time of the filing of this patent application to possibly reside broadly in the filling machine, wherein means are provided for the evacuation and/or purging of the container.

Yet another feature or aspect of an embodiment is believed at the time of the filing of this patent application to possibly reside broadly in a method for filling beverage bottles with an oxygen sensitive effervescent liquid beverage filling material under counterpressure using a beverage filling machine, said method achieving a minimal consumption of carbon dioxide gas, minimizing costs of bottling, and avoiding, restricting, and/or minimizing the absorption of oxygen by the oxygen sensitive effervescent liquid beverage filling material in a liquid reservoir for filling the beverage bottles and thereby maximizing the shelf life of said oxygen sensitive effervescent liquid beverage filling material, said beverage filling machine comprising: a plurality of beverage filling positions, each filling position comprising a beverage filling device for filling a beverage bottle; a gas return duct common to each filling device in said filling machine configured to receive displaced carbon dioxide gas from said beverage bottle during liquid filling and to supply carbon dioxide gas during carbon dioxide gas filling of said beverage bottles; a gas sink common to each filling device in said filling machine configured to receive displaced carbon dioxide gas from said beverage bottle during liquid filling and to supply carbon dioxide gas to said beverage bottle during pressurizing said beverage bottle; a connecting line supplying carbon dioxide gas to said gas sink from a carbon dioxide head space in said liquid reservoir containing said oxygen sensitive effervescent liquid beverage filling material; said gas sink being large enough to contain at least the volume of gas displaced thereto from said beverage bottle when filling with said oxygen sensitive effervescent liquid beverage filling material and small enough to be substantially flushed with carbon dioxide gas from said connecting line during a pressurizing step, thereby minimizing an amount of oxygen entering said connecting line during liquid filling of said bottle; said connecting line being configured to contain a smaller volume than a volume configured to be contained by said gas sink and a volume large enough to minimize an amount of oxygen that may enter a head space in the liquid reservoir containing said oxygen sensitive effervescent liquid beverage filling material, upon any gas being displaced from said gas sink to said connecting line, during liquid filling of said bottle; a vacuum duct common to each filling device in said filling machine; and a liquid connection configured to deliver said oxygen sensitive effervescent liquid beverage filling material from said liquid reservoir to each of said filling devices; the method comprising the steps of: moving a beverage bottle to be filled in sequence with other bottles to said filling machine; elevating said beverage bottle to be filled to a corresponding filling device thereby placing said beverage bottle in a configuration to be in flow communication with said gas return duct, said gas sink, said vacuum duct, and said liquid connection, with the operation of one or more valves; sealing said beverage bottle to be filled against the corresponding filling device; evacuating said beverage bottle sealed to said filling device by opening a first valve, thus providing flow communication between said beverage bottle sealed to said filling device and said vacuum duct; filling said beverage bottle sealed to said filling device with carbon dioxide gas by closing said first valve and opening a second valve, thus providing flow communication between said beverage bottle sealed to said filling device and said gas return duct; repeating said evacuating and said filling steps at least one time to displace a desired amount of residual air present out of said beverage bottle sealed to said filling device; pressurizing said beverage bottle sealed to said filling device with carbon dioxide gas by closing said second valve and opening a third valve, thus providing flow communication between said beverage bottle sealed to said filling device and said gas sink; maintaining a bottling pressure in said gas sink by maintaining flow communication between said gas sink and carbon dioxide gas in a head space of a said liquid reservoir containing said oxygen sensitive effervescent liquid beverage filling material for filling; filling said beverage bottle sealed to said filling device with an initial amount of said oxygen sensitive effervescent liquid beverage filling material by opening a fourth valve, thus providing flow communication between said beverage bottle sealed to said filling device and said liquid connection; displacing a first volume of carbon dioxide gas from said beverage bottle sealed to said filling device into said gas return duct; displacing a second volume of carbon dioxide gas from said beverage bottle sealed to said filling device into said gas sink; said first volume of carbon dioxide gas being greater than said second volume of carbon dioxide gas, thereby minimizing an amount of oxygen entering said gas sink; said second volume of carbon dioxide gas being less than a volume of said gas sink, thereby minimizing an amount of oxygen entering said connecting line; said second volume of carbon dioxide gas being less than a volume of carbon dioxide gas flowing from said head space of said liquid reservoir containing said oxygen sensitive effervescent liquid beverage filling material to said gas sink during said step of maintaining a bottling pressure in said gas sink, said second volume of carbon dioxide gas and said volume of carbon dioxide gas flowing into said gas sink, during said maintaining step, providing a sum of the volume of said carbon dioxide gas flowing into said gas sink from said carbon dioxide gas in a head space of a said liquid reservoir containing said oxygen sensitive effervescent liquid beverage filling material and carbon dioxide gas flowing out of said gas sink to said beverage bottle sealed to said filling device, the sum of said carbon dioxide gas flowing into and out of said gas sink resulting in a flow of carbon dioxide gas from said head space of a said liquid reservoir containing said oxygen sensitive effervescent liquid beverage filling material to said bottle sealed to said filling device, minimizing contamination of said carbon dioxide gas, in said head space of a said liquid reservoir containing said oxygen sensitive effervescent liquid beverage filling material, with said displaced gas; filling said beverage bottle sealed to said filling device with a final amount of said oxygen sensitive effervescent liquid beverage filling material by closing said third valve, thus providing flow communication between said beverage bottle sealed to said filling device and said liquid connection and said gas return duct; displacing a third volume of carbon dioxide gas from said beverage bottle sealed to said filling device into said gas return duct; sensing the level of oxygen sensitive effervescent liquid beverage filling material in said beverage bottle sealed to said filling device; stopping the filling of said beverage bottle sealed to said filling device upon said sensed level of oxygen sensitive effervescent liquid beverage filling material in said beverage bottle sealed to said filling device reaching a desired level; calming the oxygen sensitive effervescent liquid beverage filling material in said beverage bottle sealed to said filling device for a predetermined period of time to attain a pressure below the carbonating material saturation pressure and thus reducing excess bubbles; reducing the pressure in said beverage bottle sealed to said filling device to a final pressure; distancing said filled beverage bottle filled with oxygen sensitive effervescent liquid beverage filling material from the sealing relationship with the corresponding filling device; and removing said filled beverage bottle from said filling machine.

Still another feature or aspect of an embodiment is believed at the time of the filing of this patent application to possibly reside broadly in a method for filling beverage bottles with an oxygen sensitive effervescent liquid beverage filling material under counterpressure wherein each filling device is disposed proximate a perimeter of a rotor at a substantially equal distance from one another.

A further feature or aspect of an embodiment is believed at the time of the filing of this patent application to possibly reside broadly in a method for filling beverage bottles with an oxygen sensitive effervescent liquid beverage filling material under counterpressure comprising a step of providing flow communication between said gas sink and said gas return duct, prior to filling a first beverage bottle in a run of beverage bottles to be filled.

Another feature or aspect of an embodiment is believed at the time of the filing of this patent application to possibly reside broadly in a method for filling containers with a gas sensitive material under counterpressure, the method comprising the steps of: moving a container to be filled in sequence with other containers to a filling machine; sealing said container to be filled against a corresponding filling device in said filling machine, thus enabling flow communication between the container to be filled and a gas return duct, a gas chamber, and a gas sensitive material connection; pressurizing said container sealed to said filling device with an inert gas, substantially unreactive with said sensitive material, by providing flow communication between said container sealed to said filling device and said gas chamber; maintaining a filling pressure in said gas chamber by maintaining flow communication between said gas chamber and a supply of said inert gas, said gas chamber being maintained in flow communication with said supply of inert gas through an inert gas connecting line, said gas chamber being configured to contain a larger volume than a volume of said inert gas configured to be contained by said connecting line; filling said container sealed to said filling device with said gas sensitive material by providing flow communication between said container sealed to said filling device and said gas sensitive material connection; displacing a first portion of gas from said container sealed to said filling device into said gas return duct; displacing a second portion of gas from said container sealed to said filling device into said gas chamber; said second portion of gas being less than a portion of said inert gas flowing from said supply of inert gas to said gas chamber during said step of maintaining a filling pressure in said gas chamber; sensing a level of said gas sensitive material in said container sealed to said filling device; stopping the filling of said container sealed to said filling device upon said sensed level of said gas sensitive material in said container sealed to said filling device reaching a desired level; distancing said filled container from the sealing relationship with the corresponding filling device; and removing said filled container from said filling machine.

Yet another feature or aspect of an embodiment is believed at the time of the filing of this patent application to possibly reside broadly in a means for performing a method for filling containers with a gas sensitive material under counterpressure said means comprising: means for moving a container to be filled in sequence with other containers to a filling machine; means for sealing said container to be filled against a corresponding filling device in said filling machine, thus enabling flow communication between the container to be filled and a gas return duct, a gas chamber, and a gas sensitive material connection; means for pressurizing said container sealed to said filling device with an inert gas, substantially unreactive with said sensitive material, by providing flow communication between said container sealed to said filling device and said gas chamber; means for maintaining a filling pressure in said gas chamber by maintaining flow communication between said gas chamber and a supply of said inert gas, said gas chamber being maintained in flow communication with said supply of inert gas through an inert gas connecting line, said gas chamber being configured to contain a larger volume than a volume of said inert gas configured to be contained by said connecting line; means for filling said container sealed to said filling device with said gas sensitive material by providing flow communication between said container sealed to said filling device and said gas sensitive material connection; means for displacing a first portion of gas from said container sealed to said filling device into said gas return duct; means for displacing a second portion of gas from said container sealed to said filling device into said gas chamber, said second portion of gas being less than a portion of said inert gas flowing from said supply of inert gas to said gas chamber during said step of maintaining a filling pressure in said gas chamber; means for sensing a level of said gas sensitive material in said container sealed to said filling device; means for stopping the filling of said container sealed to said filling device upon said sensed level of said gas sensitive material in said container sealed to said filling device reaching a desired level; means for distancing said filled container from the sealing relationship with the corresponding filling device; and means for removing said filled container from said filling machine.

One feature or aspect of an embodiment is believed at the time of the filing of this patent application to possibly reside broadly in a container filling machine for a method for filling containers with a gas sensitive material under counterpressure comprising: a container moving arrangement configured to move a container to be filled in sequence with other containers to a filling machine; a container sealing arrangement configured to seal said container to be filled against a corresponding filling device in said filling machine, thus enabling flow communication between the container to be filled and a gas return duct, a gas chamber, and a gas sensitive material connection; a container pressurizing arrangement configured to pressurize said container sealed to said filling device with an inert gas, substantially unreactive with said sensitive material, by providing flow communication between said container sealed to said filling device and said gas chamber; a first gas connecting arrangement configured to maintain a filling pressure in said gas chamber by maintaining flow communication between said gas chamber and a supply of said inert gas, said gas chamber being maintained in flow communication with said supply of inert gas through an inert gas connecting line, said gas chamber being configured to contain a larger volume than a volume of said inert gas configured to be contained by said connecting line; a gas sensitive material filling arrangement configured to fill said container sealed to said filling device with said gas sensitive material by providing flow communication between said container sealed to said filling device and said gas sensitive material connection; a second gas connecting arrangement configured to deliver a first portion of displaced gas from said container sealed to said filling device into said gas return duct; a third gas connecting arrangement configured to deliver a second portion of displaced gas from said container sealed to said filling device into said gas chamber, said second portion of gas being less than a portion of said inert gas flowing from said supply of inert gas to said gas chamber during said step of maintaining a filling pressure in said gas chamber; a sensing arrangement configured to sense a level of said gas sensitive material in said container sealed to said filling device; a stopping arrangement configured to stop the filling of said container sealed to said filling device upon said sensed level of said gas sensitive material in said container sealed to said filling device reaching a desired level; a container moving arrangement configured to distance said filled container from the sealing relationship with the corresponding filling device; and a container moving arrangement configured to remove said filled container from said filling machine.

Another feature or aspect of an embodiment is believed at the time of the filing of this patent application to possibly reside broadly in a method for filling containers with a gas sensitive material under counterpressure wherein said supply of inert gas and a supply of said gas sensitive material are maintained in a reservoir common to a plurality of filling devices.

Yet another feature or aspect of an embodiment is believed at the time of the filing of this patent application to possibly reside broadly in a method for filling containers with a gas sensitive material under counterpressure wherein said reservoir is maintained at a filling pressure with the addition of inert gas and gas sensitive material and maintaining a head pressure of inert gas above said gas sensitive material in said reservoir.

Still another feature or aspect of an embodiment is believed at the time of the filing of this patent application to possibly reside broadly in a method for filling containers with a gas sensitive material under counterpressure comprising a step of providing flow connection between said gas chamber and said gas return duct, prior to filling a container in a run of containers to be filled.

A further feature or aspect of an embodiment is believed at the time of the filing of this patent application to possibly reside broadly in a method for filling containers with a gas sensitive material under counterpressure wherein said filling machine further comprises a vacuum duct, said method further comprising the steps of: evacuating said container sealed to said filling device, at least once, by providing flow connection between said container sealed to said filling device and said vacuum duct; filling, after said at least one evacuation, said container sealed to said filling device with said inert gas by providing flow connection between said container sealed to said filling device and said gas return duct.

Another feature or aspect of an embodiment is believed at the time of the filing of this patent application to possibly reside broadly in a method for filling containers with a gas sensitive material under counterpressure comprising at least one of a), b), c), d), e), and f): a) said gas chamber is directly connected with said supply of inert gas and said inert gas connecting line has no valve controlling the flow of said inert gas therethrough; b) said gas chamber and said gas return duct are in valved flow connection with one another; c) said gas return duct comprises a single gas return duct which is in flow connection with a plurality of filling devices in said filling machine; d) said gas chamber comprises a single gas chamber in flow connection with a plurality of filling devices in said filling machine; e) said filling machine comprising a plurality of filling devices disposed proximate a perimeter of a rotor at a substantially equal distance from one another; and f) said inert gas is carbon dioxide and said gas sensitive material is an effervescent liquid.

Yet another feature or aspect of an embodiment is believed at the time of the filing of this patent application to possibly reside broadly in a method for filling containers with a gas sensitive material under counterpressure, the method comprising the steps of: moving a container to be filled in sequence with other containers to a filling machine; sealing said container to be filled against a corresponding filling device in said filling machine, thus enabling flow connection between the container to be filled and a gas return duct, a gas chamber, and a gas sensitive material connection; pressurizing said container sealed to said filling device with an inert gas, substantially unreactive with said sensitive material, by providing flow connection between said container sealed to said filling device and said gas chamber; maintaining a filling pressure in said gas chamber by maintaining flow connection between said gas chamber and a supply of said inert gas; filling said container sealed to said filling device with said gas sensitive material by providing flow connection between said container sealed to said filling device and said gas sensitive material connection; displacing a first portion of gas from said container sealed to said filling device into said gas return duct; displacing a second portion of gas from said container sealed to said filling device into said gas chamber; said second portion of gas being less than a portion of said inert gas flowing from said supply of inert gas to said gas chamber during said step of maintaining a filling pressure in said gas chamber, said second portion of gas and said portion of gas flowing into said gas chamber, during said maintaining step, providing a sum of the volume of said inert gas flowing into said gas chamber from said supply of inert gas and inert gas flowing out of said gas chamber to said container sealed to said filling device, the sum of said inert gas flowing into and out of said gas chamber resulting in a flow of inert gas from said supply of inert gas to said container sealed to said filling device, minimizing contamination of said inert gas, in said supply of inert gas, with said displaced gas; sensing a level of said gas sensitive material in said container sealed to said filling device; stopping the filling of said container sealed to said filling device upon said sensed level of said gas sensitive material in said container sealed to said filling device reaching a desired level; distancing said filled container from the sealing relationship with the corresponding filling device; and removing said filled container from said filling machine.

Still another feature or aspect of an embodiment is believed at the time of the filing of this patent application to possibly reside broadly in a container filling machine for a method for filling containers with a gas sensitive material under counterpressure comprising: a container moving arrangement being configured to move a container to be filled in sequence with other containers to a filling machine; a container sealing arrangement configured to seal said container to be filled against a corresponding filling device in said filling machine, thus enabling flow connection between the container to be filled and a gas return duct, a gas chamber, and a gas sensitive material connection; a container pressurizing arrangement configured to pressurize said container sealed to said filling device with an inert gas, substantially unreactive with said sensitive material, by providing flow connection between said container sealed to said filling device and said gas chamber; a first gas connecting arrangement configured to maintain a filling pressure in said gas chamber by maintaining flow connection between said gas chamber and a supply of said inert gas; a gas sensitive material filling arrangement configured to fill said container sealed to said filling device with said gas sensitive material by providing flow connection between said container sealed to said filling device and said gas sensitive material connection; a second gas connecting arrangement configured to deliver a first portion of displace gas from said container sealed to said filling device into said gas return duct; a third gas connecting arrangement configured to deliver a second portion displaced gas from said container sealed to said filling device into said gas chamber, said second portion of gas being less than a portion of said inert gas flowing from said supply of inert gas to said gas chamber during said step of maintaining a filling pressure in said gas chamber, said second portion of gas and said portion of gas flowing into said gas chamber, during said maintaining step, providing a sum of said inert gas flowing into said gas chamber from said supply of inert gas and inert gas flowing out of said gas chamber to said container sealed to said filling device, the sum of said inert gas flowing into and out of said gas chamber resulting in a flow of inert gas from said supply of inert gas to said container sealed to said filling device, minimizing contamination of said inert gas, in said supply of inert gas, with said displaced gas; a sensing arrangement configured to sense a level of said gas sensitive material in said container sealed to said filling device; a stopping arrangement configured to stop the filling of said container sealed to said filling device upon said sensed level of said gas sensitive material in said container sealed to said filling device reaching a desired level; a container moving arrangement configured to distance said filled container from the sealing relationship with the corresponding filling device; and a container moving arrangement configured to remove said filled container from said filling machine.

A further feature or aspect of an embodiment is believed at the time of the filing of this patent application to possibly reside broadly in a means for a method for filling containers with a gas sensitive material under counterpressure, said means comprising: means for moving a container to be filled in sequence with other containers to a filling machine; means for sealing said container to be filled against a corresponding filling device in said filling machine, thus enabling flow connection between the container to be filled and a gas return duct, a gas chamber, and a gas sensitive material connection; means for pressurizing said container sealed to said filling device with an inert gas, substantially unreactive with said sensitive material, by providing flow connection between said container sealed to said filling device and said gas chamber; means for maintaining a filling pressure in said gas chamber by maintaining flow connection between said gas chamber and a supply of said inert gas; means for filling said container sealed to said filling device with said gas sensitive material by providing flow connection between said container sealed to said filling device and said gas sensitive material connection; means for displacing a first portion of gas from said container sealed to said filling device into said gas return duct; means for displacing a second portion of gas from said container sealed to said filling device into said gas chamber, said second portion of gas being less than a portion of said inert gas flowing from said supply of inert gas to said gas chamber during said step of maintaining a filling pressure in said gas chamber, said second portion of gas and said portion of gas flowing into said gas chamber, during said maintaining step, providing a sum of said inert gas flowing into said gas chamber from said supply of inert gas and inert gas flowing out of said gas chamber to said container sealed to said filling device, the sum of said inert gas flowing into and out of said gas chamber resulting in a flow of inert gas from said supply of inert gas to said container sealed to said filling device, minimizing contamination of said inert gas, in said supply of inert gas, with said displaced gas; means for sensing a level of said gas sensitive material in said container sealed to said filling device; means for stopping the filling of said container sealed to said filling device upon said sensed level of said gas sensitive material in said container sealed to said filling device reaching a desired level; means for distancing said filled container from the sealing relationship with the corresponding filling device; and means for removing said filled container from said filling machine.

Another feature or aspect of an embodiment is believed at the time of the filing of this patent application to possibly reside broadly in a method for filling containers with a gas sensitive material under counterpressure wherein the step of maintaining a filling pressure in said gas chamber by maintaining flow connection between said gas chamber and a supply of said inert gas is carried out by maintaining said gas chamber in flow connection with said supply of inert gas through an inert gas connecting line, said gas chamber being configured to contain a larger volume than a volume configured to be contained by said inert gas connecting line.

Yet another feature or aspect of an embodiment is believed at the time of the filing of this patent application to possibly reside broadly in a method for filling containers with a gas sensitive material under counterpressure wherein said supply of inert gas and a supply of said gas sensitive material are maintained in a reservoir common to a plurality of filling devices.

One feature or aspect of an embodiment is believed at the time of the filing of this patent application to possibly reside broadly in a method for filling containers with a gas sensitive material under counterpressure wherein said reservoir is maintained at a filling pressure with the addition of inert gas and gas sensitive material and maintaining a head pressure of inert gas above said gas sensitive material in said reservoir.

Another feature or aspect of an embodiment is believed at the time of the filing of this patent application to possibly reside broadly in a method for filling containers with a gas sensitive material under counterpressure comprising a step of providing flow connection between said gas chamber and said gas return duct, prior to filling a first container in a run of containers to be filled.

Yet another feature or aspect of an embodiment is believed at the time of the filing of this patent application to possibly reside broadly in a method for filling containers with a gas sensitive material under counterpressure wherein said filling machine further comprises a vacuum duct, said method further comprising the steps of: evacuating said container sealed to said filling device, at least once, by providing flow connection between said container sealed to said filling device and said vacuum duct; filling, after said at least one evacuation, said container sealed to said filling device with said inert gas by providing flow connection between said container sealed to said filling device and said gas return duct.

Still another feature or aspect of an embodiment is believed at the time of the filing of this patent application to possibly reside broadly in a method for filling containers with a gas sensitive material under counterpressure comprising at least one of a), b), c), d), e), and f): a) said gas chamber is directly connected with said supply of inert gas and said inert gas connecting line has no valve controlling the flow of said inert gas therethrough; b) said gas chamber and said gas return duct are in valved flow connection with one another; c) said gas return duct comprises a single gas return duct which is in flow connection with a plurality of filling devices in said filling machine; d) said gas chamber comprises a single gas chamber in flow connection with a plurality of filling devices in said filling machine; e) said filling machine comprising a plurality of filling devices disposed proximate a perimeter of a rotor at a substantially equal distance from one another; and f) said inert gas is carbon dioxide and said gas sensitive material is an effervescent liquid.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated Jan. 28, 2008, and/or cited elsewhere are hereby incorporated by reference as if set forth in their entirety herein as follows: DE 42 01 698, having the following English translation of the German title "Method for filling bottles or similar containers with a liquid product and apparatus for carrying-out this method," published on Jul. 29, 1993.

All of the patents, patent applications or patent publications, which were cited in the International Search Report dated Apr. 25, 2008, and/or cited elsewhere are hereby incorporated by reference as if set forth in their entirety herein as follows: EP 1,216,952, having the following English translation of the German title "Filling machine," published on Jun. 26, 2002; EP 1,162,167, having the following English translation of the German title "Method and device for filling bottles, cans and similar containers with a liquid product," published on Dec. 12, 2001; and EP 1,584,601, having the following English translation of the German title "Filling machine of the rotary type," published on Oct. 12, 2005.

Some examples of methods for determining parameters such as the filling volume, the empty volume, and the filling height which may possibly be utilized or adapted for use in at least one possible embodiment may possibly be found in the following U.S. Pat. No. 6,463,964, invented by Clüsserath, published on Oct. 15, 2002 and entitled "Method of operating a machine for filling bottles, cans or the like beverage containers with a beverage, and a beverage container filling machine"; U.S. Pat. No. 4,134,407, issued to Elam on Jan. 16, 1979 and entitled "External pressure-volume monitor"; U.S. Pat. No. 4,282,757 issued to Cohn on Aug. 11, 1981 and entitled "Device for detecting rate of change in pressure"; U.S. Pat. No. 4,391,412 issued to Goldhammer on Jul. 5, 1983 and entitled "Apparatus for limiting filling height of containers"; U.S. Pat. No. 4,765,342 issued to Urman et al. on Aug. 23, 1988 and entitled "Timed drift compensation for rate volume monitor"; U.S. Pat. No. 4,788,456 issued to Urman et al. on Nov. 29, 1988 and entitled "Variable threshold for rate volume monitor"; U.S. Pat. No. 4,928,687 issued to Lampotang et al. on May 29, 1990 and entitled "CO 2 diagnostic monitor"; U.S. Pat. No. 5,008,653 issued to Kidd et al. on Apr. 16, 1991 and entitled "Fluid detector with overfill probe"; U.S. Pat. No. 5,110,208 issued to Sreepada et al. on May 5, 1992 and entitled "Measurement of average density and relative volumes in a dispersed two-phase fluid"; U.S. Pat. No. 5,244,550 issued to Inoue on Sep. 14, 1993 and entitled "Two liquid separating methods and apparatuses for implementing them"; U.S. Pat. No. 5,279,157 issued to Mattis et al. on Jan. 18, 1994 and entitled "Liquid level monitor"; and U.S. Pat. No. 6,099,470 issued to Bahr on Aug. 8, 2000 and entitled "Monitor for diffusable chemical substance", all of these U.S. patents being hereby expressly incorporated by reference as if set forth in their entirety herein.

Some examples of electric probes which may possibly be utilized or adapted for use in at least one possible embodiment may possibly be found in the following U.S. Pat. No. 5,190,084 issued to Diehl et al. on May 3, 1991 and entitled "Filling element for filling machines for dispensing liquid"; U.S. Pat. No. 4,903,530 issued to Hull on Dec. 8, 1988 and entitled "Liquid level sensing system"; U.S. Pat. No. 4,908,783 issued to Maier on Apr. 28, 1987 and entitled "Apparatus and method for determining liquid levels"; and U.S. Pat. No. 4,921,129 issued on Jul. 11, 1988 to Jones et al. and entitled "Liquid dispensing module" which U.S. patent is hereby expressly incorporated by reference as if set forth in its entirety herein.

Some examples of swirl-inducing devices that may possibly be utilized or adapted for use in at least one possible embodiment may possibly be found in the following U.S. patents: U.S. Pat. Pub. No. 2005/0257499, entitled "Beverage bottling plant for filling bottles with a liquid beverage material having a filling machine", invented by Krulitsch, published on Nov. 24, 2005; U.S. Pat. No. 5,501,253, entitled "Apparatus for filling vessels with liquid;" U.S. Pat. No. 5,190,084, entitled "Filling element for filling machines for dispensing liquid;" and U.S. Pat. No. 4,757,847, entitled "Filling machine filling element having no filling tube."

The patents, patent applications, and patent publication listed above in the preceding five paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 009 435.5, filed on Feb. 23, 2007, having inventors Ludwig CLüSSERATH, Dieter-Rudolf KRULITSCH, and Manfred HÄRTEL, and DE-OS 10 2007 009 435.5 and DE-PS 10 2007 009 435.5, and International Application No. PCT/EP2008/000316, filed on Jan. 17, 2008, having WIPO Publication No. WO 2008/101572 and inventors Ludwig CLÜSSERATH, Dieter-Rudolf KRULITSCH, and Manfred HÄRTEL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2008/000316 and German Patent Application 10 2007 009 435.5, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/000316 and DE 10 2007 009 435.5 from which this patent application claims priority which do not have to do with the correction of the translation in this patent application are not to be included in this patent application in the incorporation by reference.

Any statements about admissions of prior art in the original foreign patent applications PCT/EP2008/000316 and DE 10 2007 009 435.5 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Filling and capping machine
2 Bottles
2.1 Flow of containers
3 Rotor of the actual filling machine
4 Filling position
5 Filling element
6 Container carrier
7 Conveyor
8 Container or machine inlet
9 Outlet or transfer star wheel
10 Capper
11 Machine outlet
12 Housing of the filling element 5
13 Liquid duct
14 Liquid connection
15 Bowl
15.1 Liquid space
15.2 Headspace
15.3 Supply connection
16 Carbon dioxide gas supply line
16.1 Control valve
17 Discharge opening
17.1 Seal at discharge opening 17
18 Liquid valve
18.1 Tappet
18.2 Valve body
19 Actuator element
20 Probe
21 Gas duct
22, 23, 24 Control valve
25-28 Gas duct
29 Return gas duct
30 Vacuum duct
31 Additional duct or gas sink
32 Connecting line
33 Throttled gas connection in the filling element 5
A Direction of rotation of the rotor
B Direction of flow in the line 32
W1-W11 Angular sectors of the rotational motion of rotor 3

What is claimed is:

1. A method of filling bottles or similar containers with a liquid under counterpressure, using a filling machine which has, on a rotor, a plurality of filling elements, a bowl that is common to the filling elements, whereby the interior of the bowl forms a liquid space which is occupied by the liquid being bottled and a headspace above the liquid for an inert gas under a pressure or a filling pressure, and at least one return gas duct which is common to the filling elements or to each of a group of filling elements, whereby before the filling, the interior of the container is pressurized by means of a controlled gas path of each filling element with inert gas originating from the headspace of the bowl and at the filling pressure, and during the filling at least some of the inert gas is displaced from the containers by the incoming liquid into the at least one return gas duct, wherein the individual container is pressurized from at least one additional gas duct that functions as a gas sink and is common to the filling element or a group of filling elements, which additional gas duct is connected by means of at least one gas connection to the headspace of the bowl.

2. The method according to claim 1, wherein at least the pressurization of the containers and the filling of the containers are performed under counterpressure by controlling the gas paths of the filling elements such that, taking into consideration a gas exchange between the filling elements, the quantity of inert gas taken from the additional gas duct during the pressurization is greater than the quantity of gas displaced from the bottles into this additional gas duct during the filling under counterpressure.

3. The method according to claim 2, wherein inert gas is fed in a controlled manner to the headspace of the bowl to maintain the filling pressure.

4. The method according to claim 3, wherein the additional gas duct that functions as a gas sink has a volume which is significantly greater than the volume of the rotor-side gas connection that connects this gas duct with the headspace of the bowl.

5. The method according to claim 4, wherein the containers are pressurized exclusively from the additional gas duct that functions as a gas sink.

6. The method according to claim 5, wherein during the filling of the containers, some of the inert gas is also displaced by means of a controlled gas path of each filling element into the additional gas duct that functions as the gas sink.

7. The method according to claim 6, wherein the pressurization is preceded by a partial pressurization of the containers by mans of a controlled gas path of the individual filling element from the return gas duct.

8. The method according to claim 7, wherein before the pressurization or before the partial pressurization, there is at least one purging of the containers via controlled gas paths of the filling elements with inert gas.

9. The method according to claim 8, wherein the container is flushed with inert gas from the return gas duct.

10. The method according to claim 9, wherein before and/or after the purging via controlled gas paths of the filling elements, the container which is in sealed contact with the respective filling element is evacuated.

11. The method according to claim 10, wherein carbon dioxide gas is used as the inert gas, and under certain operating conditions, return gas can be conducted by means of a controlled gas path from the additional duct to the return gas duct or from the connecting line to the return gas duct.

12. The method according to claim 11, wherein there is at least a one-time evacuation or purging of the container prior to the filling of the container.

13. A rotary filling arrangement for the filling of bottles or similar containers with a liquid under counterpressure, with a bowl which is provided on a rotor that can be driven in rotation around a vertical machine axis, whereby the interior of the bowl forms a liquid space which is occupied by the liquid being bottled and a headspace above the surface of the liquid being bottled for an inert gas under a pressure or a filling pressure, with a plurality of filling elements located on the periphery of the rotor, each of which has a fluid duct which is in communication with the liquid space of the bowl and a discharge opening with a controlled liquid valve, with at least one common return gas duct on the rotor which is common to the filling elements or a group of filling elements, and with controlled gas paths realized in the filling elements, by which gas paths the individual container to be filled and located in sealed contact with a filling element can be pressurized with an inert gas at the filling pressure from the headspace of the bowl, and which makes possible a removal of the inert gas displaced from the containers during the filling at least partly to the return gas duct, wherein on the rotor for the filling elements or for each group of filling elements at least one common additional gas duct that functions as a gas sink is provided, which is in communication by at least one gas connection with the headspace of the bowl, and with which the filling elements are in communication with their controlled gas paths which effect the pressurization of the containers.

14. The rotary filling arrangement according to claim 13, wherein the additional gas duct that functions as a gas sink has a volume which is greater than the total volume of the rotor-side gas connection which connects this gas duct with the headspace of the bowl.

15. The rotary filling arrangement according to claim 14, wherein the at least one additional gas duct is in constant or substantially constant communication with the headspace of the bowl.

16. The rotary filling arrangement according to claim 15, wherein the filling machine comprises an arrangement for the controlled feeding of inert gas into the headspace of the bowl for the maintenance of the filling pressure.

17. The rotary filling arrangement according to claim 16, wherein on the rotor, at least one vacuum duct which is common to the filling elements or to a group of filling elements is provided, to which the filling elements are connected with at least one controlled gas path which is realized in the filling elements.

18. The rotary filling arrangement according to claim 17, wherein one gas duct is common to the gas paths realized in each filling element, which gas duct empties into the interior of the container that is located in sealed contact with the related filling element.

19. The rotary filling arrangement according to claim 18, wherein the discharge opening of each filling element is realized in the form of a ring or partial ring so that it encircles a container-side opening of the gas duct which is common to the gas paths.

20. The rotary filling arrangement according to claim 19, wherein the filling elements are filling elements without filler tubes, there is a controllable connecting line between the additional duct and the return gas duct and/or the connecting line and the return gas duct, and an arrangement is provided for the evacuation and/or purging of the container.

* * * * *